US008303771B2

(12) United States Patent
Orgård et al.

(10) Patent No.: US 8,303,771 B2
(45) **Date of Patent: *Nov. 6, 2012**

(54) APPARATUS AND METHOD FOR TREATMENT OF PULP

(75) Inventors: Jonas Orgård, Stöde (SE); Jörgen Lundberg, Sundsvall (SE)

(73) Assignee: Metso Paper, Inc. (FI)

( * ) Notice: Subject to any disclaimer, the term of this patent is extended or adjusted under 35 U.S.C. 154(b) by 0 days.

This patent is subject to a terminal disclaimer.

(21) Appl. No.: 12/738,894

(22) PCT Filed: Oct. 23, 2008

(86) PCT No.: PCT/SE2008/000608

§ 371 (c)(1),
(2), (4) Date: Apr. 20, 2010

(87) PCT Pub. No.: WO2009/061247

PCT Pub. Date: May 14, 2009

(65) Prior Publication Data

US 2010/0243185 A1 Sep. 30, 2010

(30) Foreign Application Priority Data

Nov. 9, 2007 (SE) ..... 0702470

(51) Int. Cl.
*D21C 9/02* (2006.01)
*D21C 9/06* (2006.01)

(52) U.S. Cl. ..... 162/60

(58) Field of Classification Search ..... 162/55, 162/60, 252, 254
See application file for complete search history.

(56) References Cited

U.S. PATENT DOCUMENTS 7,695,591 B2 * 4/2010 Lundberg et al. ..... 162/52

FOREIGN PATENT DOCUMENTS

WO 2006130093 A1 12/2006
WO 2006130097 A1 12/2006
WO 2006130109 A1 12/2006

OTHER PUBLICATIONS

TEEMS, Technical Hint Zeroing the Force Sensor, 2005 [downloaded online Sep. 20, 2011].*
International Search Report, PCT/SE2008/000608, dated Feb. 10, 2009.

* cited by examiner

*Primary Examiner* — Anthony Calandra
(74) *Attorney, Agent, or Firm* — Lerner, David, Littenberg, Krumholz & Mentlik, LLP

(57) ABSTRACT

Washing apparatus as well as methods for washing and dewatering a cellulose pulp are disclosed comprising a rotary drum with outer compartments for pulp washing, and a stationary casing surrounding the drum to define an annular space between the casing and the drum which is divided into zones by longitudinal seals. The function of the seals is optimized by a force measurement device for measuring forces acting on the longitudinal seal for measuring a biasing force of a spring package in the measurement device and for measurement of a force acting on a load transmission shaft of the device as well as an extractor for extracting a force acting against the seal in a direction away from the drum.

5 Claims, 5 Drawing Sheets

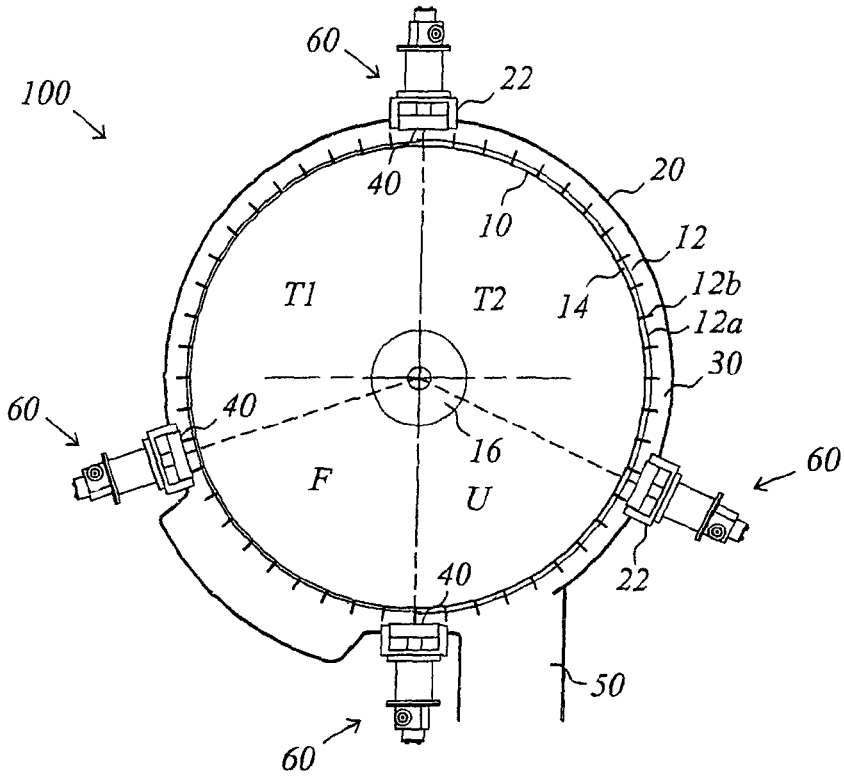
FIG. 3
FIG. 4A
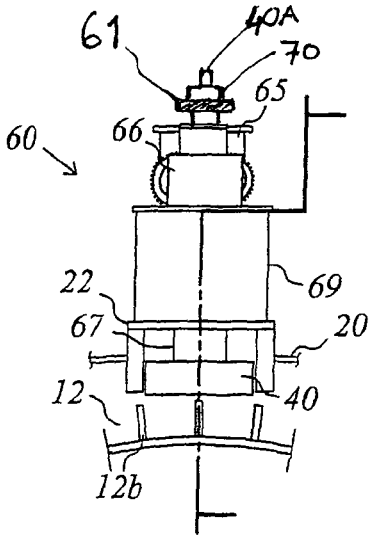
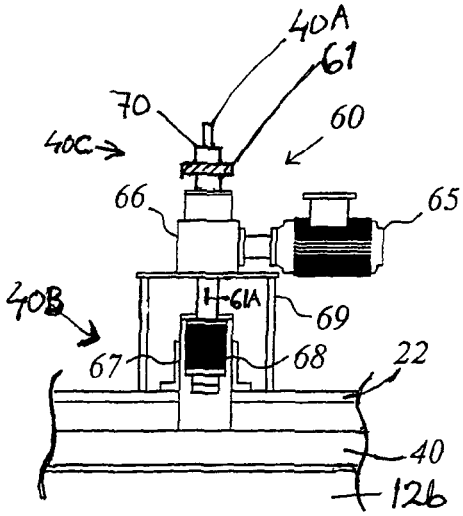
FIG. 4B

APPARATUS AND METHOD FOR TREATMENT OF PULP

CROSS REFERENCE TO RELATED APPLICATIONS

The present application is a national phase entry under 35 U.S.C. §371 of International Application No. PCT/SE2008/000608 filed Oct. 23, 2008, published in English, which claims priority from Swedish Application No. 070247-6 filed Nov. 9, 2007, all of which are incorporated herein by reference.

FIELD OF THE INVENTION

The present invention relates to a method and apparatus for force measurement and a washing apparatus for washing and dewatering of cellulosic pulp of the kind having a drum provided with compartments comprising the apparatus. The present invention also relates to a method and apparatus for seal adjustment in a washing apparatus of the above mentioned kind.

BACKGROUND OF THE INVENTION

In all fiber lines some kind of washing means is incorporated in order to separate the liquor from the digestion of the pulp. Later in the process washing means are then provided in order to separate bleaching liquor after the bleaching steps. There are a number of different types of washing equipment each of which works according to different principles.

A well known washing apparatus is the drum washer, wherein the pulp is dewatered on a rotating filter drum after the addition of washing liquid, and which displaces the liquor remaining in the liquor after previous process steps, e.g. a digestion step or a bleaching step. A negative pressure inside the drum makes the displaced liquid pass through a perforated plate arranged on the rotating drum. One development of the original drum washer is the pressurized displacement washer, wherein the filtrate under a positive pressure is made to pass through the plate. The increased pressure difference brings about a more effective displacement of the filtrate.

According to a previously known construction of a pressurized displacement washer the drum is provided with compartments, which extend in the axial direction of the drum, and are intended to be filled with pulp. The compartments are defined by walls in the form of strips provided axially all along the axis of the drum, and a bottom which is comprised of the perforated plate. The compartment spacing of the drum ensures that the cake of the pulp does not crack and move, but instead maintains the formation obtained at the facing. The perforated plate, on which the pulp has settled, is placed at a distance from the main surface of the drum, so that filtrate channels are formed in the space between the drum and the plate. Along the periphery of the drum there are at least as many filtrate channels as there are pulp compartments.

In a drum washer several different washing steps may be performed, with separate addition of washing liquid to the different steps, as well as recirculation of filtrate from one step to be used as washing liquid in another. In order to obtain a maximum washing efficiency the aim is that washing liquid intended for a specific washing step is not moved to a later washing step. (A pressure difference between the steps results in added washing liquid striving to move itself towards the lower pressure.) In order to be able to differentiate between different washing steps, which are performed in one or more washing zones in the drum, and formation steps, which are performed in the formation zone of the drum, and output steps, which are performed in the output zone of the drum (a dry content increasing zone comprises a first part of the output zone), are the respective zones which are sealed with longitudinal (that is axial) seals. These longitudinal seals are placed between the rotating drum and the surrounding casing. The filtrates from the respective zones are separated by seals in a peripherally positioned end valve provided at one or both end covers.

One problem with drum washers of the type having zones separated with the aid of longitudinal seals is that these seals are subjected to abrasion, wear and other stresses. The seals change with time, which has a negative effect on the general washing performance and also leads to the risk of leakage and shutdown.

According to the prior art there is a possibility for the working staff to make manual adjustments of the longitudinal seals. During this positioning of the seals it is thus of great help to obtain continuous and more precise information of the force acting between the drum and the seal during operation.

In Swedish Patent Publication No. 528721 C2, there is disclosed a unit and a method for adjustment of a seal in a washing apparatus for cellulosic pulp, which method comprises the steps of measuring a force acting on a longitudinal seal and moving the seal based on the measured force. It is previously known to arrange a measuring device, such as a load cell, between a jack and a seal, in order to be able to accurately record the force acting against a seal in a direction from the drum, and to then move the seal substantially in the radial direction of the drum, based on the measured force. The jack provides for transmission of a driving force, manually or from a motor, to the seal in order to adjust the seal. In order to avoid the load cell and other components becoming overloaded, a spring package is mounted between the load cell and the seal. The spring package is biased with a predetermined force. If this force is exceeded, the spring package is compressed. The load cell is mounted between the jack and the force transmission shaft. This means that the load cell cannot be exchanged during operation. Furthermore, the jack has to be dismounted in order to be able to exchange the load cell. Furthermore, the force of the spring is different for every spring package of the respective seal because of different tolerances for different seals, which means that according to the construction that is previously known through Swedish Patent Publication No. 528721 C2, it is not possible to determine which bias force is prevailing under operation in the respective spring package.

Thus, there is a demand for an improved solution to the problem of measuring forces acting on at least one seal in a washing apparatus.

One object of the present invention is thus to provide an improved washing apparatus of the type with a rotary drum provided with compartments. More specifically, an object of the present invention is to accomplish a safer and more efficient sealing mechanism for the washing apparatus. A further object hereof is to accomplish a novel, more cost effective and simpler method for measuring, during operation, the force acting on the longitudinal seal in a radial direction away from the drum. A further object of the present invention is to accomplish a method which makes it possible to exchange measuring means without stopping the operation of the washing apparatus.

SUMMARY OF THE INVENTION

In accordance with the present invention, these and other objects have now been realized by the discovery of a method of measuring the forces acting on at least one seal in a washing apparatus for washing and dewatering cellulose pulp comprising a rotary drum including a plurality of compartments disposed along the outer periphery of the rotary drum for washing the cellulose pulp, the plurality of compartments defined by a plurality of axial walls, a stationary casing disposed around the rotary drum thereby defining an annular space between the stationary casing and the rotary drum, at least one axially extending longitudinal seal dividing the annular space into a plurality of zones, and a force measurement device for measuring the force acting on the at least one seal in the radial direction of the rotary drum comprising a load transmission shaft having a first end proximate to the at least one longitudinal seal on the rotary drum and a second end distal from the rotary drum, and a spring member for transmitting a first driving force to the at least one longitudinal seal, the method comprising measuring the biasing force provided by the spring member for determining the first driving force applied to the at least one longitudinal seal when the rotary drum is not operating, measuring a second driving force acting on the load transmission shaft during operation of the rotary drum, and deriving a third driving force acting against the at least one longitudinal seal in a radial direction away from the rotary drum based on the measured first and second forces. In a preferred embodiment, the deriving of the third driving force comprises subtraction of the second driving force from the first driving force.

In accordance with one embodiment of the method of the present invention, measuring of the second driving force is carried out using a measuring member in indirect contact with the load transmission shaft through an intermediate element, whereby the biasing force can be measured by the measuring member and a traction force acting on the load transmission shaft during operation of the rotary drum can be measured as a compressive force of the same magnitude as the traction force by the measuring member. In a preferred embodiment, the measuring member is disposed in connection with the second end of the load transmission shaft.

In accordance with another embodiment of the method of the present invention, the method includes moving the location of the longitudinal seal substantially in the radial direction of the rotary drum based upon the third driving force.

In accordance with the present invention, these and other objects have also been realized by the discovery of apparatus for measuring the forces acting on at least one seal in a washing apparatus for washing and dewatering cellulose pulp, the washing apparatus comprising a rotary drum and a plurality of compartments formed along the outer periphery of the rotary drum for washing the cellulose pulp, the plurality of compartments defined by a plurality of axial walls, a stationary casing disposed around the rotary drum thereby defining an annular space between the stationary casing and the rotary drum, at least one axially extending longitudinal seal dividing the annular space into a plurality of zones, and a force measurement device for measuring the force acting on the at least one longitudinal seal in the radial direction of the rotary drum comprising a load transmission shaft having a first end proximate to the at least one longitudinal seal on the rotary drum and a second end distal from the rotary drum, a spring member for transmitting a first driving force to the at least one longitudinal seal, a jack member for driving the at least one longitudinal seal, and a measuring member for measuring the bias force provided by the spring member for determining the first driving force applied to the at least one longitudinal seal when the rotary drum is not operating and for measuring a second driving force acting on the load transmission shaft during operation of the rotary drum, and extraction means for determining a third force acting against the at least one longitudinal seal in a radial direction away from the rotary drum based on the first driving force and the second driving force. In a preferred embodiment, the measuring member is integrated with the load transmission shaft.

In accordance with one embodiment of the apparatus of the present invention, the apparatus includes an intermediate element, and the measuring member is disposed adjacent to the second end of the load transmission shaft in indirect connection with the load transmission shaft through the intermediate element. In a preferred embodiment, the measuring member is disposed on a side of the jack member turned in a direction away from the stationary casing. Preferably, the load transmission shaft includes a protruding part between the jack member and the fastening element and the measuring member is mounted on the protruding part.

In accordance with the present invention, a seal adjustment member has been discovered comprising a force measurement device as described above. Preferably, the seal adjustment unit comprises movement means for moving the longitudinal seal substantially in the radial direction with respect to the rotary drum based on the force measured by the measuring member.

In accordance with the present invention, washing apparatus has also been discovered for washing and dewatering a cellulose pulp comprising a rotary drum including a plurality of compartments disposed along the outer periphery of the rotary drum for washing the cellulose pulp, the plurality of compartments defined by a plurality of axial walls, a stationary cylindrical casing surrounding the rotary drum thereby defining an annular space between the stationary casing and the rotary drum and a plurality of axially extending longitudinal seals dividing the annular space into a plurality of zones, and a force measurement device as described above.

In accordance with the present invention, a washing apparatus has also been discovered for washing and dewatering a cellulose pulp comprising a rotary drum including a plurality of compartments disposed along the outer periphery of the rotary drum for washing the cellulose pulp, the plurality of compartments defined by a plurality of axial walls, a stationary cylindrical casing surrounding the drum thereby defining an annular space between the stationary casing and the rotary drum and a plurality of axially extending longitudinal seals dividing the annular space into a plurality of zones, and a seal adjustment device as described above.

In short the present invention provides a method for force measurement of forces acting on at least one seal with a device in a washing apparatus provided with compartments. The device for force measurement comprises a force transmission shaft, which has an extension substantially through the device, with a first end, adjacent to which the longitudinal seal is intended to be arranged. Furthermore, this device comprises a spring package intended to be biased by the device and a jack for transmission of a driving force to the seal. According to the method of the present invention, an adjustment of at least one longitudinal (i.e. axial) seal can be performed based indirectly on the measured force acting on the load transmission shaft of the force measurement device. From this measured force, a force acting on the longitudinal seal in a direction away from the drum can be extracted. This extraction takes place based on a biasing force of the spring package in the force measurement device, which has been measured in advance during a shutdown, as well as the measured force which during operation acts on the force transmission shaft of the force measurement device. The present invention also relates to a method and a unit for seal adjustment in a washing apparatus, and a washing apparatus.

The force is measured with a measuring means, for example a load cell, a strain gauge or similar means, and based on this measurement the seal is moved when necessary, such as when the seal comes too close to or too far away from the drum because of wear, pressure or form changes of the drum or when a foreign object is between the seal and the drum. Movement of the seal can be performed manually or preferably with the aid of a motor, hydraulics or any other driving means, usually connected to the seal through one or several mediation elements and/or positioning means.

The suggested force measurement of forces acting on at least one sealing means according to the present invention makes possible a construction in which the measuring means can be arranged in a position where it is more accessible, and so that an exchange of the measuring means can be accomplished during operation of the washing apparatus. The construction can thereby be made more cost effective since it is easier and less costly to exchange a measuring means which is not built into the device for force measurement so that the device has to be disassembled in order to reach the measuring means. Measurement and adjustment of the biasing force of the spring package in the force measurement device are therefore now made possible, which reduces the risk for an overload. The construction can also be made more cost effective, since less costly measuring means can be used while the measuring means according to one embodiment of the present invention is only exposed to pressure forces. According to another embodiment of the present invention a more compact and less space requiring construction can be accomplished.

According to the present invention the biasing force of the spring package can accordingly be measured in advance, before the washing apparatus is put into operation. This can be accomplished because the measuring means is in indirect connection with the load transmission shaft, preferably through an element mounted on the load transmission shaft. Preferably, the measuring means is arranged in connection with the load transmission shaft on the outside of the sealing means and outside the jack on the sealing means. During operation of the washing apparatus the force acting on the load transmission shaft of the force measuring means can be measured. The force acting on the longitudinal seal in the direction away from the drum is the biasing force of the spring package less the force measured on the load transmission shaft during operation. The extraction of the force acting against the longitudinal seal in the direction from the rotary drum can then preferably be obtained by subtracting the measured force from the biasing force of the spring package, which has been measured in advance.

According to the present invention a washing apparatus is thus also provided for washing and dewatering of cellulosic pulp, which washing apparatus comprises a rotary drum with a plurality of outer compartments on the drum for pulp to be washed, which compartments are defined by axial compartment walls distributed along the perimeter of the drum, a stationary cylindrical casing, which encloses the drum, whereby an annular space is defined between the casing and the drum and wherein the annular space by longitudinal seals extending in the axial direction of the drum is divided into zones for formation, washing and output of the pulp, which washing apparatus comprises a device for force measurement with measuring means for measuring the biasing force of the spring package during shutdown and measuring a force acting on the load transmission shaft during operation; and extraction means for extraction of a force acting on the longitudinal seal in a direction away from the drum, from the measured biasing force of the spring package and the measured force acting on the load transmission during operation.

BRIEF DESCRIPTION OF THE DRAWINGS

The present invention, as well as further objects and advantages therewith, will be best understood with reference to the subsequent detailed description and the accompanying drawings, wherein:

FIG. 3 is a side, elevational, axial cross-sectional view through a washing apparatus with a drum provided with compartments according to one embodiment of the present invention;

FIG. 4A is a side, elevational, an axial cross-sectional view of one part of a washing apparatus with a longitudinal seal as well as a device for force measurement according to one embodiment of the present invention;

FIG. 4B is a side, elevational, radial cross-sectional view of one part of the washing apparatus shown in FIG. 4A;

DETAILED DESCRIPTION

Figure 1:
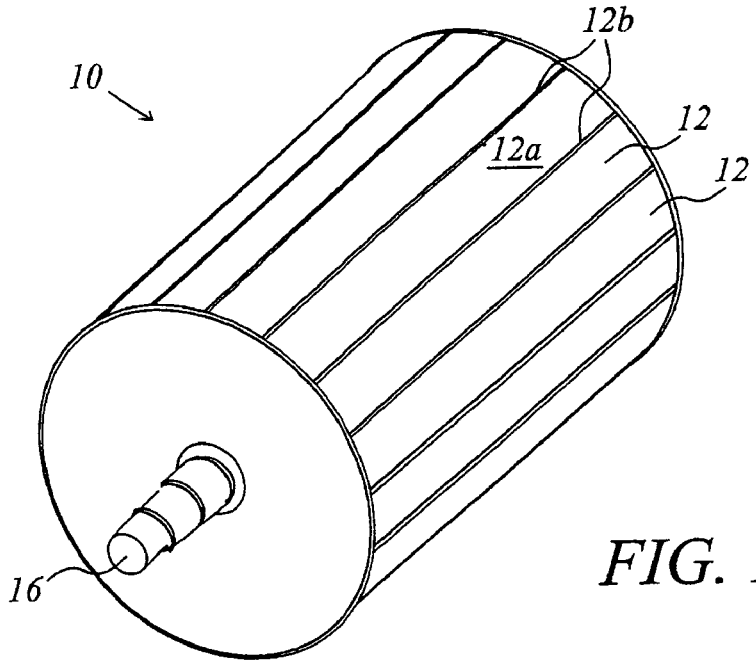
FIG. 1 is a side, perspective, schematic view of a rotary drum provided with compartments, which can be used in a washing apparatus according to the present invention.

In the drawings the same reference numbers are used for similar or corresponding parts thereof.

FIG. 1 is a schematic perspective view of a rotary drum provided with compartments which, together with a stationary casing, might be contained in a pressurized displacement washer according to the present invention. A rotary drum 10 provided with a plurality of outer compartments 12 (also called pulp compartments or cells) are shown, in which compartments the paper pulp to be washed is placed when input towards the drum. Each compartment 12 has a bottom 12*a* of a perforated plate and two compartment walls (cell walls) 12*b* arranged axially in view of the drum shaft 16. In the drum illustrated in FIG. 1 the compartment walls 12*b* are evenly distributed along the perimeter of the drum. The rotary drum 10 is generally journalled on a stationary stand (not shown) in the washing apparatus and is encased by a cylindrical casing (e.g. 20 in FIG. 2), whereby an annular space 30 is defined between the casing and the drum.

Figure 2:
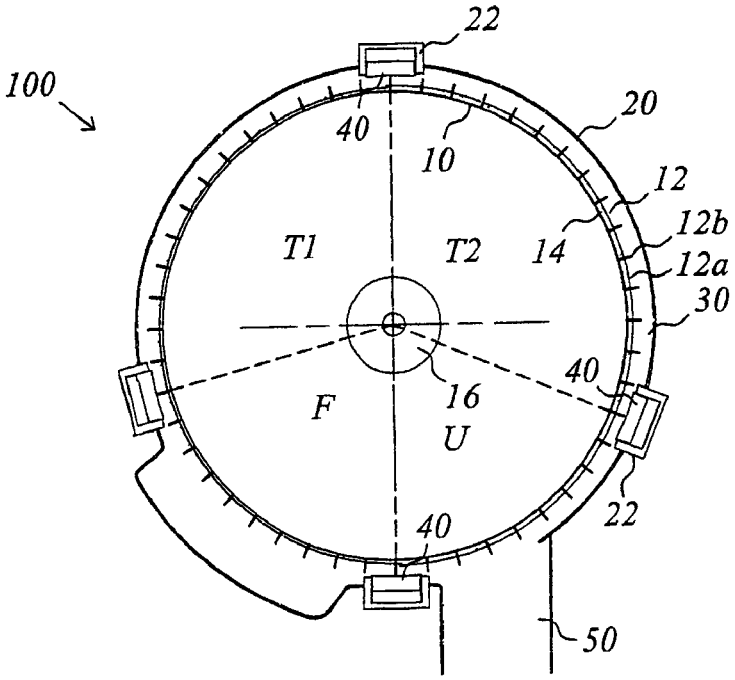
FIG. 2 is a side, elevational, schematic, axial cross-sectional view through a washing apparatus with a drum provided with compartments according to the prior art.

FIG. 2 shows an axial cross-sectional view through a washing apparatus with a rotary drum provided with compartments according to the prior art. The washing apparatus 100 comprises a plurality of axial longitudinal seals 40 placed between the rotary drum 10 and the surrounding casing 20. These longitudinal seals 40 seal between the casing 20 and the compartment walls 12*b* of the compartments and act as separating elements between different zones F, Ta, T2, U of the washing apparatus 100. The function of the seals 40 is of outmost importance, e.g. in order to ensure that washing liquid intended for a specific washing step is not moved to a later washing step, especially when, under normal conditions, there exists a difference in pressure between different washing steps. In FIG. 2 there are shown four longitudinal seals 40, which accordingly divide the annular space 30 into four zones, more specifically into a formation zone F for formation of the pulp in compartment 12 of the drum, first and a second washing zones, T1 and T2, for washing the formed pulp, and an output zone U for output of the washed pulp.

Each seal 40 has a width which is somewhat larger than the distance between two adjacent compartment walls 12*b*. Accordingly, the compartment walls 12*b* will pass the seal 40 one by one when the drum 10 rotates, and the position of the seal is such that in every moment it "covers" either one or two compartment walls 12*b*. Furthermore , the seal, as seen in an axial direction, e.g., can extend principally along the whole drum. Alternatively, the drum may have two (or several) separate seals in an axial direction, such as when the drum is provided with a ring construction, which delimits each compartment into two parts in an axial direction, so that filtrate can be led out from both end covers of the drum.

The rotary drum 10, including its compartment walls 12*b*, is normally made of steel. The longitudinal seals 40 can also be made of a metallic material, but are preferably made of a polymer material, designed to be exchanged with the aid of special parts 22 in the casing 20 that can be opened.

A drum washer 100 of the kind described above works with a continuously rotating drum 10 according to the following principle: Pulp for washing is fed into the formation zone F (the inlet is not shown), whereby the pulp places itself in the compartments 12 on the drum 10 as long and narrow rectangles in the axial direction of the drum against the perforated plate forming the compartment bottom 12*a*. Thanks to the compartment spacing of the drum the formation of the pulp cake is maintained. Washing liquid is added to the annular space 30 and filtrate is pressed out of the mass and passes thereby the perforated plate. This preferably takes place under an overpressure, in order to obtain an improved dewatering of the pulp. The perforated plate is placed at a distance from the drum 10 so that filtrate channels 14 are formed in the space between the drum 10 and the perforated plate. The washing may, as in FIG. 2, be repeated in two or several steps under different pressures and with separated washing liquids. Used liquid is normally fed back to a preceding process step. The washed pulp is output through an outlet opening 50.

As mentioned in the background section hereof, the longitudinal seals of the drum washer are subjected to abrasion, wear and other stresses. The seals change with time, which has a negative impact on the general washing performance, and can also lead to a risk of leakage and shutdown. In particular, it has been observed that the positions of the longitudinal seals of the drum washer are changed and are displaced because of changed operating conditions. Changed operating conditions might cause substantial differences in pressure and/or temperature of the washing apparatus, whereby the drum washer presents form changes. Thus, the respective positions of the seals are changed with respect to the drum and the sealing performance is negatively affected. According to the prior art, under these circumstances, reference is made to the method according to Swedish Patent Publication No. SE528721 C2 for adjustment of the seal.

According to a first aspect according to the present invention, there is suggested a mechanism for force measurement of forces acting on at least one seal in a washing apparatus, which makes possible a more sophisticated handling of the longitudinal seals of the washing drum. According to a second aspect of the present invention, there is suggested a mechanism for seal adjustment based on an obtained force measurement according to the first aspect of the present invention. FIG. 3 shows a washing apparatus 10 in a cross-sectional view, wherein devices 60 for force measurement according to the present invention have been arranged in connection with the longitudinal (axial) seals 40.

A preferred embodiment of the device 60 for force measurement will now be described with reference to FIGS. 4A and 4B, showing part of a washing apparatus with a device for force measurement in an axial and radial cross section, respectively. A longitudinal seal 40 of the type which seals between zones in the washing drum 10 is shown in a position when it is in contact with a compartment wall 12*b*. The illustrated device 60 for force measurement comprises a motor 65, a jack 66, a cylinder 67, a spring package 68 and a measuring means such as a load cell 61 or a strain gauge 61A. A support structure 69 surrounds the spring package 68 and partly also the cylinder 67. The device for force measurement comprises a load transmission shaft 40A, which has an extension substantially through the unit 60 in the radial direction of the drum, with a first outer end 40B in connection with which the longitudinal seal is arranged. The load cell 61 is mounted in connection with the other outer end 40C of the load transmission shaft 40A, on a protruding part L (see FIG. 5) of the load transmission shaft 40A, between the jack 66 and a fastening element 70, such as a nut. This placement allows for the load cell 61 to be removed under operation of the washing apparatus for exchange and repair. According to an alternative embodiment, instead of the load cell 61, a measuring means in the form of a strain gauge 61A (see also FIG. 5 and the following description), such as a filament strain gauge, can be integrated with the load transmission shaft 40A.

The cylinder 67 acts as a positioning means which keeps the longitudinal seal 40 away from the drum, in the radial direction. Movement of the seal 40 in a substantially radial direction is driven by the motor 65, the rotary motion of which is transformed into a linear motion through the jack 66. The jack 66 is connected to the cylinder 67 and in that way the driving power of the motor 65 is transferred to the seal 40. (The function of the spring package 68 is described below.) The function of the load cell 61 and/or the strain gauge 61A is to measure the biasing force of the spring package during shutdowns and during operation to measure the force acting on the load transmission shaft 40A. For that purpose it is preferably placed, as in the example, connected to the load transmission shaft 40A and outside the jack 66, on the side that is turned in a direction from the casing 20.

Each device 60 further comprises extraction means (not shown in FIGS. 4A-B) for extraction of a force acting against the longitudinal seal in a direction away from the drum, from the measured biasing force of the spring package 68 and the measured force acting on the load transmission shaft 40A during operation. Furthermore, the units 60 comprise movement means (not shown in FIGS. 4A-B; see FIG. 8) in order to move the seal 40 thereafter, which movement is indirectly based on the measured force during operation in relation to the biasing force of the spring package. The force is measured with a measuring means, such as the load cell 62 or similar device, and based on this measurement the seal is moved when necessary, such as when the seal comes too close or too far away from the drum because of wear, pressure or form changes of the drum or when a foreign object is between the seal and the drum.

Figure 5:
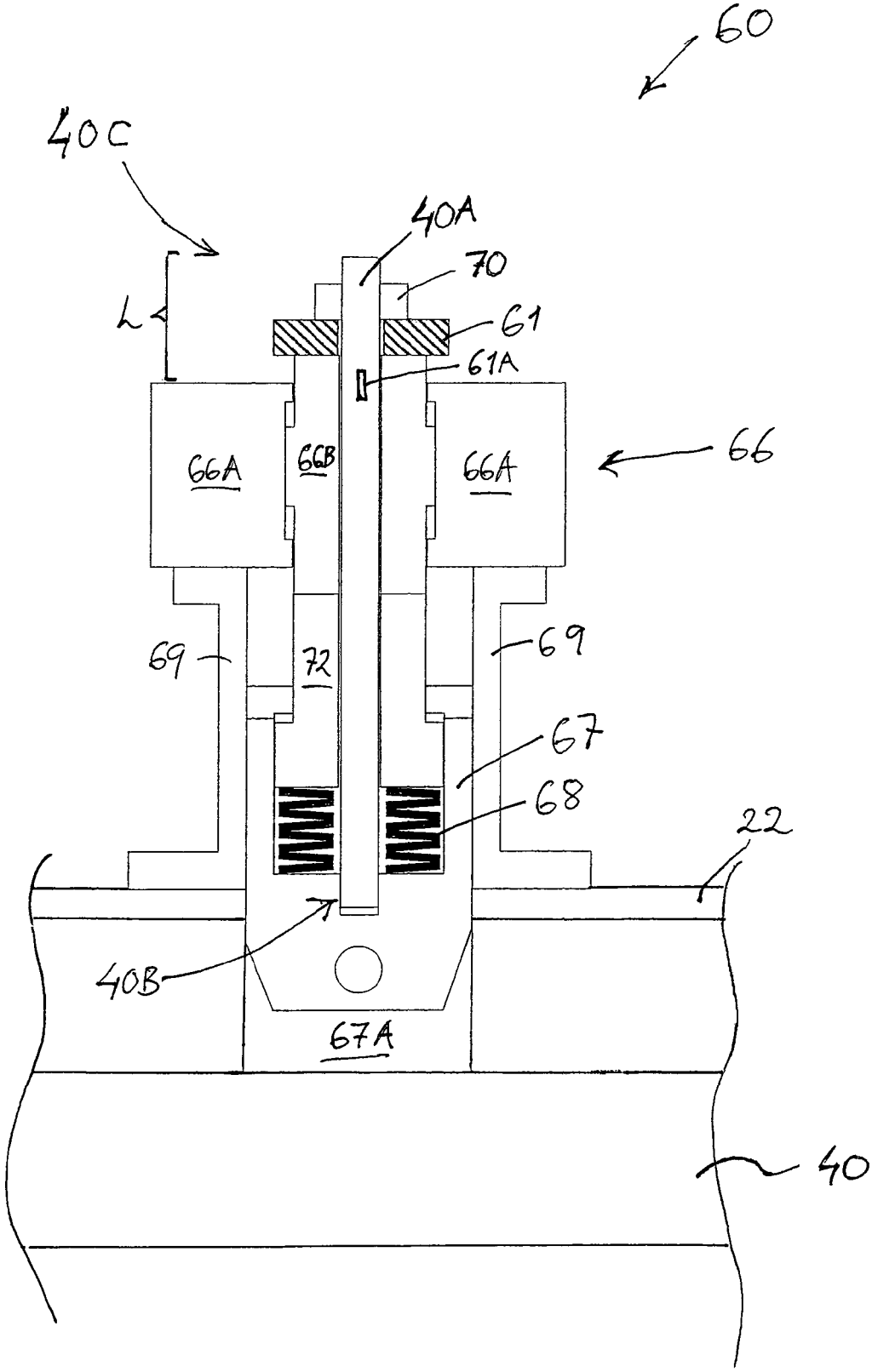
FIG. 5 is a side, elevational, schematic view of a part of a device for force measurement according to one embodiment of the present invention.

FIG. 5 shows a schematic outline diagram in an axial perspective view of a device for force measurement of forces acting on at least one seal according to one embodiment of the present invention. The illustrated device 60 for force measurement comprises a longitudinal seal 40 arranged at a casing 20 of a washing apparatus according to the invention. Furthermore, the device 60 comprises a jack 66 with a house 66A and a jack axis 66B. Manual operation, or a motor (not shown), drives the jack. The device also comprises a cylinder 67 and a cylinder extension 67A attached to the cylinder 67, in which extension the seal 40 is arranged through the cylinder 67 associated with a first outer end 40B of a load transmission shaft 40A. Furthermore, the device 60 comprises a spring package 68 and a measuring means such as a load cell 61 and/or a strain gauge 61A. A support structure 69, such as a shelf, surrounds the spring package 68, the jack 66 and partly also the cylinder 67. The load transmission shaft 40A, which biases the spring package 68 is provided to the cylinder 67 and is arranged to extend in a radial direction through the device 60 and through the jack shaft 66B. The load cell 61 is mounted in connection with a second outer end 40C of the load transmission shaft 40A, on a protruding part L of the load transmission shaft 40A, between the jack shaft 66B and a fastener 70, such as a nut. The alternatively used strain gauge 61A is integrated in the load transmission shaft 40A. The cylinder 67 acts as a positioning means which keeps the longitudinal seal 40 away from the drum in a radial direction. Movement of the seal 40 substantially in a radial direction is accomplished by the motor (not shown), or manually, the rotary motion being mediated into a linear movement through the jack 66. The jack 66 is connected to the cylinder 67 through an extension part 72 and the spring package 68, and in that way the driving force of the motor 65 is transferred to the seal 40. (The function of the spring package 68 will be described below.) The function of the measuring means, i.e. the load cell 61 or the strain gauge 61A, is to measure the force acting on the load transmission shaft 40A during operation. For that purpose it is thus placed in an indirect connection through the fastener 70 with the load transmission shaft 40A and suitably, as according to the example shown in FIG. 5, in connection through the fastener with the load transmission shaft 40A, placed between the jack 66 and the fastener 70. If for example the load cell 61 or the strain gauge 61A measures a force of 19 kN and the spring package is biased with a force of 20 kN, by extraction a force of 1 kN will be obtained, which is the force acting on the longitudinal seal 40 in a direction from the drum.

Figure 6:
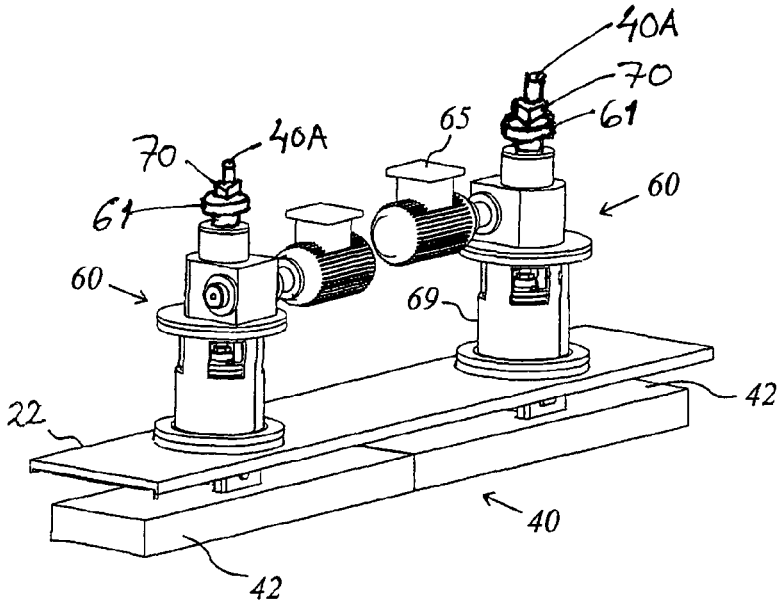
FIG. 6 is a front, perspective view of a longitudinal seal provided with two devices for force measurement according to one embodiment of the present invention.

According to one embodiment of the present invention the mechanism for force measurement comprises more than one device for force measurement for each seal. This is illustrated in FIG. 6, which shows a longitudinal seal 40 provided with two devices 60 for force measurement, one adjacent to each end. These force measurement devices 60 might be comprised of units 60A, which preferably are provided with functionally separate, i.e. individually controlled movement means, whereby different parts 42 of the seal 40 can be moved independently of each other. The movement means in FIG. 6 is partly surrounded by the support structure 69, but its motor 65 and jack 66 can be seen in the figure. In that way, efficient sealing is provided also in those cases when, e.g., the seal 40 is unevenly worn or objects having entered between the seal and the drum (10 in FIG. 4A) only affect part of the seal 40. In order to facilitate movement of the respective seal part 42 the connection between the cylinder and the seal 40 is articulated in this case. Movement of the cylinder still takes place mainly in the radial direction of the drum.

As has been mentioned above, the longitudinal seal 40 consists, according to a preferred embodiment, of a polymer material. In this manner, a supporting part of plate or the like (not shown) of a more stiff material is arranged in connection with the seal in order to prevent undesired bending of the same. Embodiments where intermediate parts are arranged between the seal and the casing 20 thus lie within the scope of the present invention.

Again with reference to FIGS. 4A and 4B, the device 60 for force measurement according to the present invention is provided with a spring means 48, typically arranged such that it surrounds the cylinder 67 with a movable part closest to the drum and a stationary point farthest from the drum 10. A function of the spring means is that it functions as a heavy emergency action for moving the seal, e.g. if the motor should be out of order and some object enters between the seal and the drum.

Figure 7:
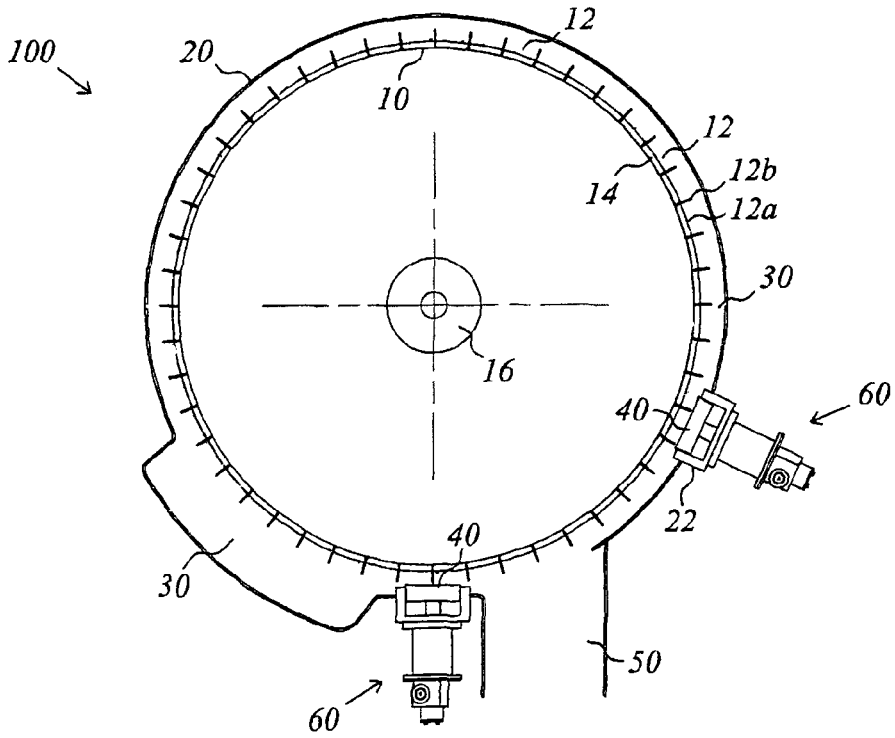
FIG. 7 is a side, elevational, schematic axial cross-sectional view through a washing apparatus with a drum provided with compartments according to one embodiment of the present invention.

A further embodiment of the present invention provides for a safer sealing function for the washing drum in cases in which a plurality of devices 60 for measuring force are present. The devices 60 might be arranged in connection with the same (FIG. 6) or different seals (FIG. 3 and FIG. 7) and might function in normal operation either independently of each other without communication between themselves or in mutual communication.

There may also be embodiments, wherein some longitudinal seals of the washing apparatus are provided with devices for force measurement while others lack this functionality. Such applications of course also lie within the scope of the present invention. Normally it is most important to optimize the function of those seals adjoining a formation zone and an output zone of the drum, respectively. According to one embodiment of the present invention, illustrated in FIG. 7, force measurement according to the present invention is only present with reference to the first and the last seal of the washing apparatus.

Figure 8:
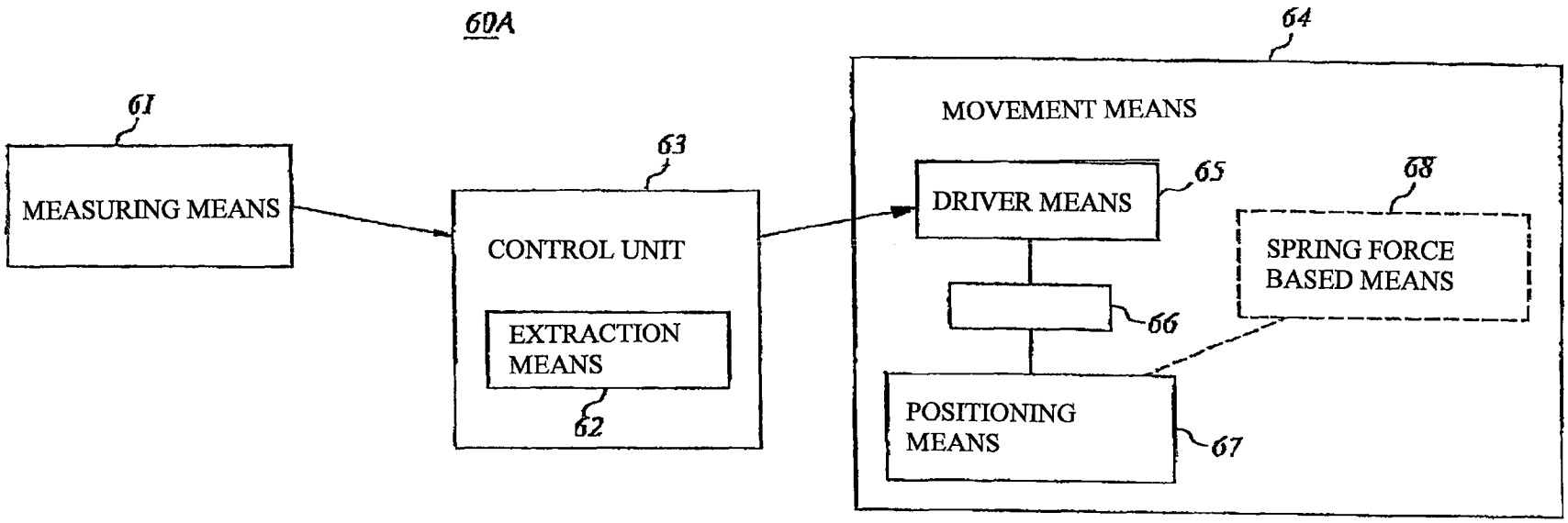
FIG. 8 is a schematic block diagram of a unit for seal adjustment, comprising a device for force measurement according to one embodiment of the present invention.

FIG. 8 is a schematic block diagram of a unit 60A for seal adjustment according to a preferred embodiment of the present invention. The illustrated unit 60A for seal adjustment, comprising a device 60 for force measurement as has been described above, comprises a measurement means 61 for force measurement, e.g. a load cell or a pressure gauge, from which measurement signals are transferred to a controller/function 63, e.g. a computer program with particular adopted control algorithms. This normally takes place automatically with chosen, relatively short time intervals, which gives a substantially continuous seal adjustment. The unit 60A for seal adjustment comprises an extraction means 62, which is adopted to extract (i.e. read out, bring forward or calculate) a value of a force or a parameter from the signal that is recorded with the measurement means 61. The extraction means 62 is preferably computer bases and integrated with the control unit 63, as in FIG. 8. Other variants are however also conceivable.

The control unit 63 communicates in its turn with a driver means 65 which drives the movement of the seal and is thus comprised in the movement means 64 of the unit 60A. The driver means can for example be an electric motor or a hydraulic driver unit. The position of the seal is governed by transferring the driver movement of the driver means 65 to a positioning means 67, e.g. a cylinder which is physically connected with the seal and arranged to keep the seal in a desired position mainly in a radial direction. This can be done directly or through on or several mediation elements 66. One example of such a mediation element is the jack shown in FIGS. 4A and 4B, but depending on among other things, the character of the driver means 65, other functional units might be used for transferring driving force to movement at the positioning means 67.

As has been mentioned above the movement means 64 also comprises a spring force based means 68 which, through the positioning means 67 moves the seal when the upper capacity limit of the driver means 65 has been reached. Furthermore, the movement means according to some applications can be adopted for movement of the longitudinal seal based also on one or several pressures in the surroundings of the seal. The illustrated adjustment unit 60A includes a unit 62 for pressure measurement, which communicates with the control unit 63 in order to make possible seal adjustment based also on one or several pressures in the surroundings at the lateral surfaces or the outside of the seal.

It is inherent that the above described method for seal adjustment can be varied within the scope of the invention.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A method of measuring the forces acting on at least one seal in a washing apparatus for washing and dewatering cellulose pulp comprising a rotary drum including a plurality of compartments disposed along the outer periphery of said rotary drum for washing said cellulose pulp, said plurality of compartments defined by a plurality of axial walls, a stationary casing disposed around said rotary drum thereby defining an annular space between said stationary casing and said rotary drum, at least one axially extending longitudinal seal dividing said annular space into a plurality of zones, and a force measurement device for measuring the force acting on said at least one seal in the radial direction of said rotary drum comprising a load transmission shaft having a first end proximate to said at least one longitudinal seal on said rotary drum and a second end distal from said rotary drum, and a spring member for transmitting a first driving force to said at least one longitudinal seal, said method comprising measuring, by means of said force measurement device, the biasing force provided by said spring member for determining said first driving force applied to said at least one longitudinal seal when said rotary drum is not operating, measuring, by means of said force measurement device, a second driving force acting on said load transmission shaft during operation of said rotary drum, and deriving a third driving force acting against said at least one longitudinal seal in a radial direction away from said rotary drum based on said measured first and second forces.

2. The method of claim 1 wherein said deriving of said third driving force comprises subtraction of said second driving force from said first driving force.

3. The method of claim 1 wherein said measuring of said second driving force is carried out using a measuring member in indirect contact with said load transmission shaft through an intermediate element, whereby said biasing force can be measured by said measuring member and a traction force acting on said load transmission shaft during operation of said rotary drum can be measured as a compressive force of the same magnitude as said traction force by said measuring member.

4. The method of claim 3 wherein said measuring member is disposed in connection with said second end of said load transmission shaft.

5. The method of claim 1 including moving the location of said longitudinal seal substantially in the radial direction of said rotary drum based upon said third driving force measured by said measuring member.

* * * * *

UNITED STATES PATENT AND TRADEMARK OFFICE

CERTIFICATE OF CORRECTION

PATENT NO. : 8,303,771 B2
APPLICATION NO. : 12/738894
DATED : November 6, 2012
INVENTOR(S) : Jonas Orgård et al.

It is certified that error appears in the above-identified patent and that said Letters Patent is hereby corrected as shown below:

In the Specification
Column 2, line 21, delete “is” and insert therefor --are--.
Column 6, line 20, delete “an”.
Column 6, line 49, delete “are” and insert therefor --is--.
Column 10, line 50, delete “bases” and insert therefor --based--.
Column 10, line 62, delete “on” and insert therefor --one--.
Column 11, line 2, “force based” should read --force-based--.

Signed and Sealed this
Twentieth Day of May, 2014

Michelle K. Lee

Michelle K. Lee
*Deputy Director of the United States Patent and Trademark Office*